US005846009A

United States Patent [19]

Noguchi et al.

[11] Patent Number: 5,846,009

[45] Date of Patent: Dec. 8, 1998

[54] WRITING TOOL

[75] Inventors: Yoshio Noguchi; Tomiji Ueki, both of Kawagoe, Japan

[73] Assignee: Kotobuki & Co., Ltd., Kyoto, Japan

[21] Appl. No.: 870,109

[22] Filed: Jun. 5, 1997

[30] Foreign Application Priority Data

Jul. 19, 1996 [JP] Japan ..... 8-191261

[51] Int. Cl.[6] ..... B43K 21/16

[52] U.S. Cl. ..... 401/65; 401/67

[58] Field of Search ..... 401/65, 54, 67, 401/94

[56] References Cited

U.S. PATENT DOCUMENTS 4,358,210 11/1982 Hashimoto et al. ..... 401/65

4,884,911 12/1989 Oikawa ..... 401/65

5,009,533 4/1991 Kageyama ..... 401/65

*Primary Examiner*—David J. Walczak

*Attorney, Agent, or Firm*—David O'Reilly

[57] ABSTRACT

A writing tool in which flexible pieces 24a projecting diametrically outward are provided in sleeve 24 of writing shaft body 11, while holding holes 10a are provided in outer case 10. By inserting parts of flexible pieces 24a into holding holes 10a, respectively, writing shaft body 11 is held within outer case 10 by engaging outer case 10. Holding holes 10a are through holes formed in the side of outer case 10, wherein a distance r1 between the outer surface of outer case 10 near front edges F of holding holes 10a and the central axis of outer case 10 is approximately equal to or smaller than a distance r2 between the inner surface of outer case 10 near rear edges R of holding holes 10a and the central axis of outer case 10.

5 Claims, 4 Drawing Sheets

WRITING TOOL

BACKGROUND OF THE INVENTION (1) Field of the Invention

The present invention relates to a writing tool such as a mechanical pencil, a ball-point pen and others, in particular to a writing tool provided with a writing shaft body held within an outer case by engaging the writing shaft body with holding holes formed in the side of the outer case.

(2) Description of the Prior Art

Heretofore, such a writing tool, is disclosed as a mechanical pencil in Japanese Patent Laying Application No. 6213 of 1995 (Heisei 7), in which the mechanical pencil comprises an outer case, a lead pipe inserted into the outer case and provided with a chuck at the head thereof, a chuck ring put on the outside of the chuck, a sleeve contacting a rear edge of the chuck ring and slidable against the outer case, and a spring inserted between the sleeve and the lead pipe, wherein the sleeve is provided with a plurality of flexible pieces spreading diametrically outward. Parts of the flexible pieces are inserted into holding holes provided in the inner wall of the outer case, respectively, wherein the outside of each flexible piece has an inclining part brought into contact with a rear edge of each holding hole.

Accordingly, by inserting parts of the flexible pieces into the holding holes, respectively, the writing shaft body comprised of the lead pipe, the chuck ring, and the sleeve can be held within the outer case, and when writing pressure or power acts excessively on a lead, a cushioning function is performed by the flexible pieces bending diametrically inward by which the lead is drawn into the outer case and prevented from breaking.

In order to form the holding holes in the outer case, there is a method in which the holding holes are made in the outer case which has been formed, or a method in which the outer case and the holding holes are formed at a time by using a split mold. However, in the former case, much labor and higher production cost are required. Further, in the latter, the number of the outer cases which can be get at once from one mold apparatus is decreased to that extent, and partition lines appear on the surface of the outer case to make outward appearance thereof poor.

BRIEF SUMMARY OF INVENTION

Accordingly, it is an object of the present invention to provide a writing tool having a structure which enables holding holes to be provided in an outer ease easily.

The above-mentioned object is attained, according to the present invention, by a writing tool comprising an outer case having a plurality of holding holes, and a writing shaft body held within the outer case by engaging the holding holes, wherein the holding holes are through holes formed in the side of the outer case, and a distance r1 between the outer surface of the outer case near front edges of the holding holes and the central axis of the outer case is approximately equal to or smaller than a distance r2 between the inner surface of the outer case near rear edges of the holding holes and the central axis of the outer case.

According to the present invention, a distance r1 between the outer surface of the outer case near front edges of the holding holes and the central axis of the outer case is approximately equal to or smaller than a distance r2 between the inner surface of the outer case near rear edges of the holding holes and the central axis of the outer case. Through holes, as holding holes, can be formed in the outer case without using a split mold, by providing part of the contact of a cavity determining the outside of the outer case and a core pin determining the inside of the outer case. Since forming can be made with a take-off mold, without the necessity of a split mold, problems can be solved of eliminating partition lines that appear on the surface of the outer case, and the number of the outer case obtained from one mold apparatus are decreased, therefore the outer case can be produced without making the outward appearance thereof poor and at low cost.

In the present invention, the writing tool is preferably a mechanical pencil including a writing shaft body comprised of a lead pipe arranged within the outer case and provided with a chuck at the head thereof, a chuck ring put on the outside of the chuck, a sleeve movable in the axial direction against the outer case, and a spring inserted between the sleeve and the lead pipe. The sleeve is provided with flexible pieces projecting diametrically outward, and a part of each flexible pieces is inserted into the holding hole, by which the writing shaft body engages the outer case.

When writing pressure acts excessively on a lead, cushioning functions are performed by flexible pieces bending diametrically inward so that the sleeve moves back in an axial direction, by which the lead is drawn into the outer case and prevented from breaking.

When mounting the writing shaft body into the outer case, it is inserted into the outer case from the rear end thereof, in which the flexible pieces of the sleeve bend diametrically inward, and therefore the writing shaft body can be easily inserted into the outer case.

In the present invention, the outside of the flexible pieces are preferably formed with inclined parts which are brought into contact with rear end walls of the holding holes.

According to the present invention, by using parts which are brought into contact with the rear end walls of the holding holes, when writing pressure acts excessively on a lead, the inclining parts formed in the outer surfaces of flexible pieces are displaced against rear edges of the holding holes so that the sleeve can move smoothly back in an axial direction.

In the present invention, the inside of the outer case is preferably formed with guide grooves extending in an axial direction for guiding the flexible pieces to corresponding holding holes.

According to the present invention, through the guide grooves extending in the axial direction for guiding the flexible pieces into corresponding holding holes, when mounting the writing shaft body into the outer case, the flexible sleeve pieces can be introduced securely into the holding holes.

In the present invention, the outer case is preferably formed with a mold comprised of a cavity for forming the outside of the outer case, and a core pin for forming the inside of the outer case. Parts of the cavity corresponding to the holding holes project diametrically inward as compared with another part which does not correspond to holding holes, while parts of core pin corresponding to the holding holes project diametrically outward, so that the cavity and the core pin inserted into the cavity are brought partly into contact with each other, such that the outer case having holding holes can be formed by molding, and after molding, the outer case can be drawn out of the cavity together with the core pin.

BRIEF DESCRIPTION OF THE DRAWINGS

In the drawings,

FIG. 4(*b*) is an enlarged sectional view of a flexible piece on the sleeve shown in FIG. 4(*a*);

DETAILED DESCRIPTION

Figure 1:
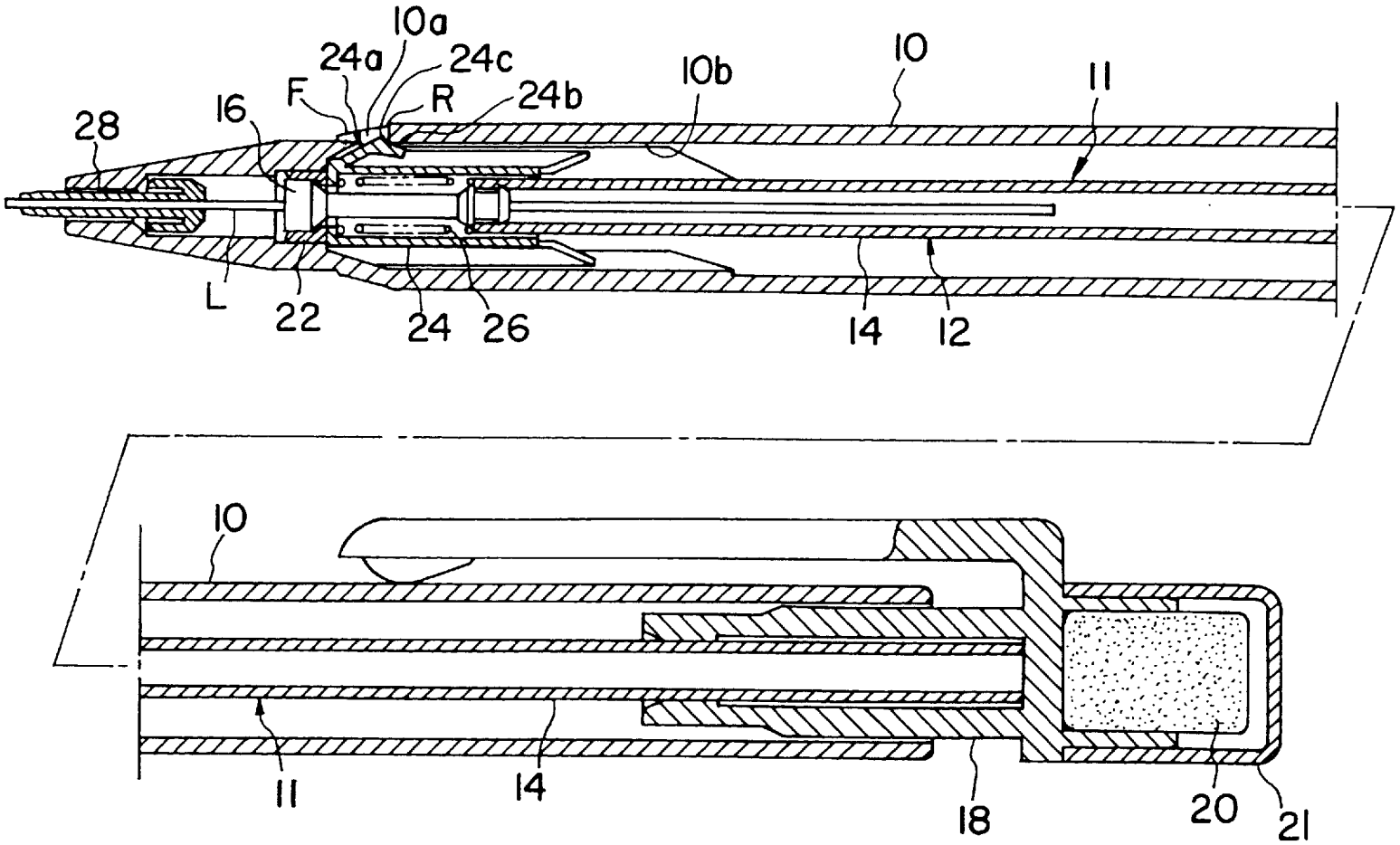
FIG. 1 is a vertical section of a first embodiment of the present invention.
Figure 2:
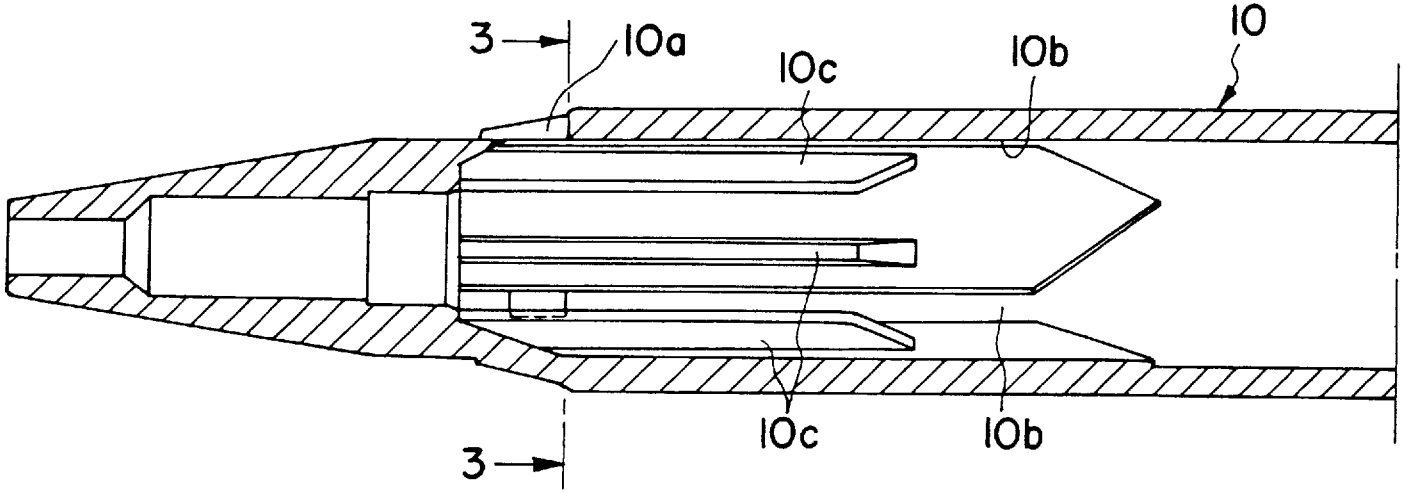
FIG. 2 is a vertical section of a part of an outer case in the embodiment shown in FIG. 1.
Figure 3:
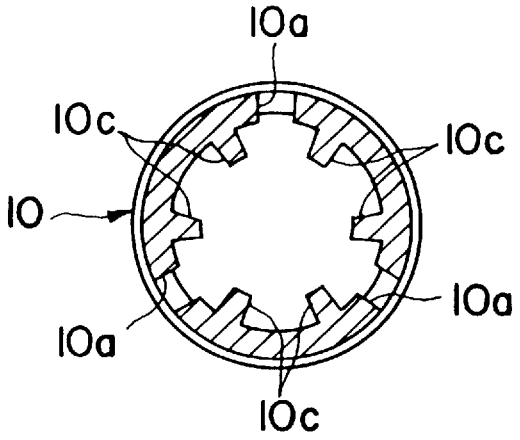
FIG. 3 is a section taken along line 3—3 in FIG. 2.

Referring to the drawings, an embodiment of the present invention is explained. FIGS. 1, 2, and 3 show an example applied to a mechanical pencil.

A writing tool of the present invention comprises an outer case 10, with a front portion having a diameter which becomes gradually smaller approaching the head of the outer case to form a tapered surface. The tapered surface is formed with a plurality of holding holes 10*a*. In this embodiment, three holding holes 10*a* are formed at intervals of 120° in the circumferential direction. The inside surface of outer case 10 has guide grooves 10*b* formed in an axial direction, which communicate with corresponding holding holes 10*a*. Ribs 10*c* are formed between adjacent guide grooves 10*b* and 10*b* in pairs, respectively, for a total of six, which project toward the center and extend in an axial direction.

Writing shaft body 11 is held within outer case 10. Writing shaft body 11 is a unit assembly comprised of lead pipe 12, chuck ring 22 and sleeve 24. Lead pipe 12 has lead case 14 and chuck 16 connected with a front portion of the lead case, which are mounted within outer case 10 so as to be movable in the axial direction. Knocking part 18 is attached removably to a rear end of lead pipe 12. Further, eraser 20 and eraser cap 21 are attached removably to a rear end of knocking part 18.

Chuck ring 22 is put on the outside of chuck 16. Sleeve 24 is arranged so as to be brought into contact with a rear end of chuck ring 22. Spring 26 is inserted between a front end of the inside of sleeve 24 and a front end of lead case 14 so as to force lead pipe 12 backward against outer case 10, such that a conventional lead advancing mechanism is formed by chuck 16, chuck ring 22, and the spring 26. In the drawings, lead pipe 28 holding lead L is able to be projected out from a front end of outer case 10.

Figure 4:
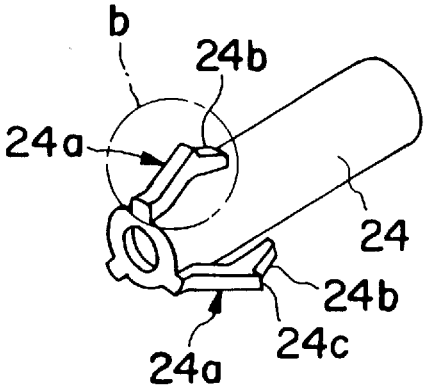
FIG. 4(*a*) is a perspective view of a sleeve in the embodiment shown in FIG. 1.
Figure 4:
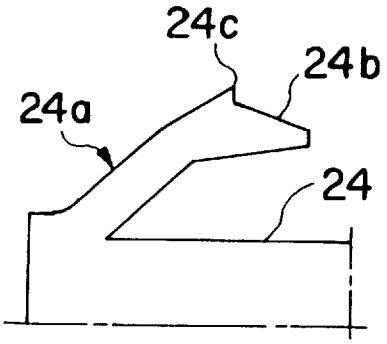

As shown in FIGS. 4(*a*) and (*b*), the above-mentioned sleeve 24 has a plurality of flexible pieces 24*a* (in this embodiment, three flexible pieces 24*a* arranged at intervals of 120° in the circumferential direction) on a front portion of the outside of sleeve 24. Each flexible piece 24*a* projects diametrically outward. A rear end of the outside of each flexible piece 24 is formed into an inclining part 24*b*. Perpendicular surface 24*c* is formed at an outer peak of inclining part 24*b*, which is approximately parallel to a wall of rear edge R of holding hole 10*a* of the outer case under the condition of sleeve 24 mounted within outer case 10.

As shown in FIG. 1, a part of each flexible piece 24*a* is inserted into each holding hole 10*a*, so that each flexible piece 24*b* engages with each holding hole 10*a*, preventing each flexible piece 24*a* from projecting diametrically outward with inclining part 24*b* being brought into contact with rear edge R of holding hole 10*a*. In this way, writing shaft body 11 is held within outer case 10.

Figure 5:
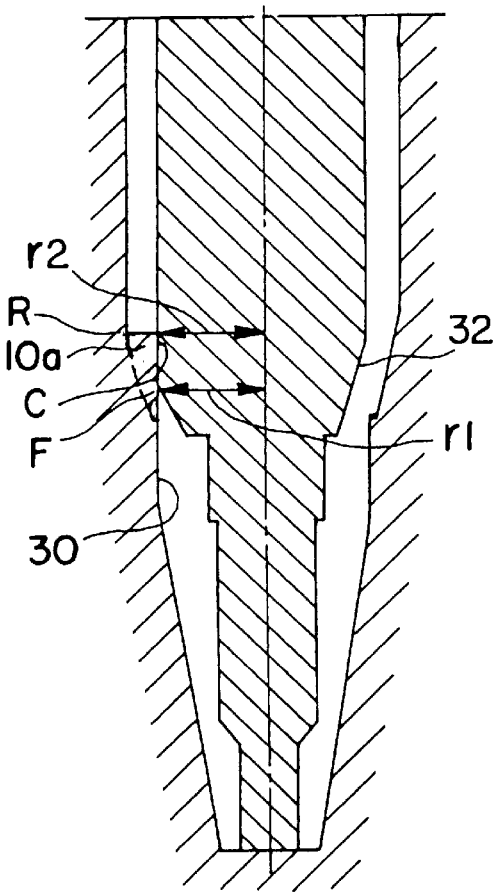
FIG. 5 is a view of an example of a mold used for forming holding holes in an outer case in the embodiment shown in FIG. 1.

An example of a mold for forming an outer case used to form holding hole 10*a* in plastic outer case 10 of the above-mentioned mechanical pencil is shown in FIG. 5, in which numeral 30 designates a cavity of the mold, and numeral 32 designates a core pin. The part of cavity 30 corresponding to holding hole 10*a* protrudes diametrically inward as compared with a part of cavity 30 in which holding hole 10 is not formed, while the part of core pin 32 corresponding to holding hole 10*a* protrudes diametrically outward. Cavity 30 and core pin 32 are brought into contact with each other by a part C shown in FIG. 5, by which through holes are formed as holding holes 10*a*. Distance r1 between an outer surface of outer case 10 in the vicinity of front edge F of holding hole 10*a* and the central axis of outer case 10 is approximately equal to distance r2 between an inner surface of outer case 10 in the vicinity of rear edge R of holding hole 10*a* and central axis of outer case 10, that is $r1 \approx r2$, such that the outer case 10 formed can be drawn out together with core pin 32 from cavity 30.

In this way, through holding holes 10*a* can be formed in outer case 10, simultaneously with the formation of outer case 10, without using a split mold to form outer case 10. Thereby, disadvantageous point can be solved of a parting line appearing on the surface of outer case 10, and the number of products obtained at the same time becomes smaller. Accordingly, the outward appearance of outer case 10 is not marred and can be produced at a low cost.

Further, when mounting writing shaft body 11 within outer case 10, writing shaft body 11 is inserted into a rear end of outer case 10. At this time, flexible pieces 24*a* of sleeve 24 are moved forward into outer case 10 and bent inward as flexible pieces 24*a* are prevented from projecting diametrically outward by outer case 10. Since flexible pieces 24*a* have such flexibility that they can be bent diametrically, flexible pieces 24*a* can be moved forward into outer case 10 easily without using a jig. Further, flexible pieces 24*a* are guided by guide grooves 10*b* which have wider frontages at their ends, respectively so that flexible pieces 24*a* can arrive securely at holding holes 10*a*. Further, a portion of sleeve 24 other than flexible pieces 24*a* is moved forward by sliding on ribs 10*c* provided on the inside of outer case 10, in which ribs 10*c* provide a small frictional force to sleeve 24 so that it is prevented from dropping unexpectedly out of outer case 10.

Writing body 11 is stopped at the point where sleeve 24 is brought into contact with the inside of outer case 10. Flexible pieces 24*a* project diametrically outward until inclining parts 24*b* of flexible pieces 24*a* are brought into contact with rear edge R of holding hole 10*a*, so that flexible pieces 24*a* engage with holding holes 10*a*. Even if there is some size error between sleeve 24 and holding holes 10*a* of outer case 10, the size error is compensated to the extent flexible pieces 24 protrude.

In using a mechanical pencil according to the present invention, if excessive pressure of writing is applied to lead L, a pressure on lead L pushes chuck ring 22 and sleeve 24 rearward together with lead pipe 12 having chuck 16 for holding lead L. Flexible pieces 24*a* of sleeve 24 bend diametrically inward, inclining parts 24*b* move against rear edge R of holding hole 10*a* in outer case 10, and as a result sleeve 24 slides on ribs 10*c* rearward in an axial direction, by which lead L moves into outer case 10 and is prevented from being broken, thereby the cushion action is performed.

If sleeve 24 slides on ribs 10*c* rearward in an axial direction, the axial displacement of sleeve 24 is prevented at the point where perpendicular surfaces 24*c* are brought into a contact with the surfaces of walls of rear edges R in holding holes 10*a*, respectively, so that sleeve 24 cannot move further back. Therefore, flexible pieces 24*a* are prevented from dropping out of holding holes 10*a*. On the other hand, when the cushioning action does not act on lead L, sleeve 24 is returned securely to its original position.

Figure 6:
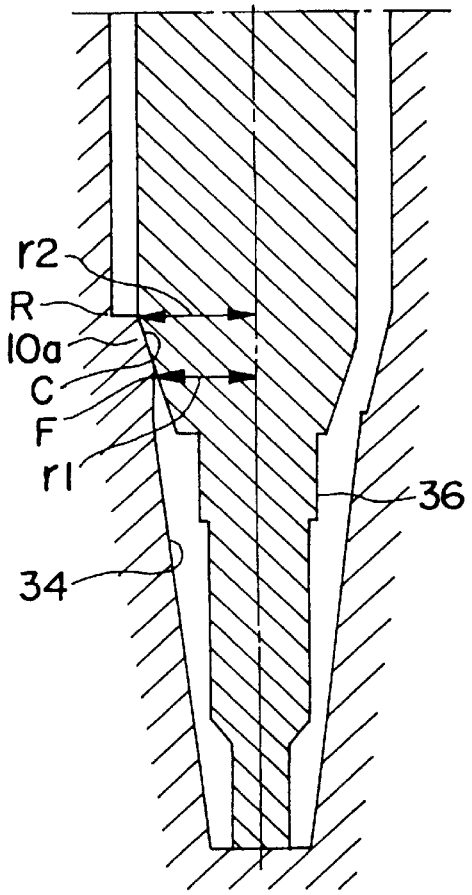
FIG. 6 is an another example of a mold used for forming holding holes in an outer case in the embodiment shown in FIG. 1.

FIG. 6 shows an another example of a mold for outer case 10 used to form holding holes 10*a*. In FIG. 6, numeral 34 designates a cavity, and numeral 36 designates a core pin. Parts of cavity 34 corresponding to holding holes 10*a* project diametrically inward as compared with another part of cavity 34 which does not correspond to holding holes 10*a*. In the same manner, parts of core pin 36 corresponding to holding holes 10*a* project diametrically outward, so that cavity 34 and core pin 36 are brought into contact with each other at areas shown at C in FIG. 6. Accordingly, through holding holes 10*a* can be formed. Outer case 10 has a shape in which distance r1 between the outer surface of outer case 10 near front edge F of holding holes 10*a* and the central axis of outer case 10 is smaller than distance r2 between the inner surface of outer case 10 near rear edge R of holding holes 10*a* and the central axis of outer case 10, that is $r1<r2$, such that the outer case 10 formed can be drawn together with core pin 36 out of cavity 34.

As shown in FIGS. 5 and 6, in order to form outer case together while forming the through holding holes by using a take-off mold, it is necessary that distance r1 between the outer surface of outer case 10 near front edge F of holding holes 10*a* and the central axis of outer case 10 be approximately equal to or smaller than distance r2 between the inner surface of outer case 10 near rear edge R of holding holes 10*a* and the central axis of outer case 10. The number of "to be approximately equal" is that within very small size variations, for example within about 5/100 mm, even if distance r1 is larger than distance r2, it is possible to forcibly draw a core pin out of a cavity: this possible range is included in "to be approximately equal". In particular, when making outer sleeve 10 of a soft resin such as polypropylene, it is possible to forcibly draw a core pin out of a cavity.

It is also possible to improve the workability and decrease production costs by forming outer case 10 together with holding holes 10*a* by the possibility of allowing the core pin to be drawn out of a cavity without interfering with formed products.

In order to satisfy the condition of distance r1 being approximately equal to or smaller than distance r2, without ruining the outer shape of outer case 10 or without giving a particular shape to outer case 10, holding holes 10*a* are preferably made in a tapered surface at the head of outer case 10 as in this embodiment. However, it is not necessarily restricted to this.

In the above-mentioned embodiment, only one example of a mechanical pencil is mentioned. However, this invention can be also applied to a ball-point pen, in which flexible pieces projecting outward are formed which are integral with the refill of a ball-point pen, and the flexible pieces can engage with holding holes formed in an outer case formed in same manner as described in the above-mentioned outer case.

What is claimed is:

1. A writing tool comprising an outer case having a plurality of holding holes, and a writing shaft body held within the outer case by engaging the holding holes, wherein the holding holes are through holes formed in the side of the outer case, and a distance (r1) between an outer surface of the outer case near front edges of the holding holes and the central axis of the outer case is not greater than approximately a distance (r2) between an inner surface of the outer case near rear edges of the holding holes and the central axis of the outer case.

2. A writing tool as claimed in claim 1, wherein the writing tool is a mechanical pencil, and the writing shaft body is comprised of a lead pipe arranged within the outer case and provided with a chuck at a head end thereof, a chuck ring mounted on a forward end of the chuck, a sleeve movable in an axial direction against the outer case, and a spring inserted between the sleeve and the lead pipe, wherein the sleeve is provided with flexible pieces projecting diametrically outward, and parts of the flexible pieces are inserted into the holding holes, respectively, whereby the writing shaft body is held in the outer case.

3. A writing tool as claimed in claim 2, wherein the outside of the flexible pieces are formed with inclining parts brought into contact with rear ends of the holding holes.

4. A writing tool as claimed in claim 2 or 3, wherein the inside of the outer case is formed with guide grooves extending in an axial direction for guiding the flexible pieces into the holding holes.

5. A writing tool as claimed in any of claims 1 through 3, wherein the outer case is formed by a mold comprised of a cavity for forming the outside of the outer case, and a core pin forming the inside of the outer case, wherein parts of the cavity corresponding to the holding holes project diametrically inward as compared with another part which does not correspond to holding holes, while parts of core pin corresponding to the holding holes project diametrically outward, so that the cavity and the core pin inserted into the cavity are brought partly into contact with each other, such that the outer case having holding holes can be formed by molding, and after molding of the outer case, the outer case can be drawn out of the cavity together with the core pin.

* * * * *